US007131409B2

(12) United States Patent
Tanno et al.

(10) Patent No.: US 7,131,409 B2
(45) Date of Patent: Nov. 7, 2006

(54) VALVE TIMING CHANGER

(75) Inventors: Keiji Tanno, Odawara (JP); Motomichi Tashiro, Odawara (JP)

(73) Assignee: Mikuni Corporation, Tokyo (JP)

( * ) Notice: Subject to any disclaimer, the term of this patent is extended or adjusted under 35 U.S.C. 154(b) by 26 days.

(21) Appl. No.: 10/522,783

(22) PCT Filed: Jul. 28, 2003

(86) PCT No.: PCT/JP03/09537

§ 371 (c)(1),
(2), (4) Date: Jan. 31, 2005

(87) PCT Pub. No.: WO2004/011778

PCT Pub. Date: Feb. 5, 2004

(65) Prior Publication Data

US 2005/0235935 A1 Oct. 27, 2005

(30) Foreign Application Priority Data

Jul. 31, 2002 (JP) ..... 2002-222982

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 5,377,638 A 1/1995 Mueller
5,386,807 A 2/1995 Linder
5,450,825 A 9/1995 Geyer et al.
6,302,071 B1 * 10/2001 Kobayashi ..... 123/90.16
6,345,595 B1 * 2/2002 Yamada ..... 123/90.15
2001/0008129 A1 7/2001 Yamada

FOREIGN PATENT DOCUMENTS

| | | |
|---|---|---|
| JP | 04/132414 | 12/1992 |
| JP | 5-195728 | 8/1993 |
| JP | 6-066115 | 3/1994 |
| JP | 3033582 | 2/2000 |
| JP | 2000-274215 | 10/2000 |
| JP | 2002-054408 | 2/2002 |

* cited by examiner

*Primary Examiner*—Thomas Denion
*Assistant Examiner*—Zelalem Eshete
(74) *Attorney, Agent, or Firm*—Wenderoth, Lind & Ponack, L.L.P.

(57) ABSTRACT

A valve timing change apparatus of the present invention is an apparatus for changing the relative angular position between a cam shaft 10 and a sprocket 30, which comprises an angle change mechanism 80 changing and holding the relative angular position between the cam shaft 10 and the sprocket 30 by oil pressure, an oil pressure generating mechanism 90 for generating oil pressure for driving the angle change mechanism 80 by relative rotation, and an electromagnetic retarder 100 for generating relative rotation at the oil pressure generating mechanism 90. With this structure, simplification and downsizing of the apparatus, reduction of engine load, suppression of oil pressure drop, etc. can be obtained. Then, a plurality of the apparatus can be mounted on an engine. In this manner, downsizing of the valve timing change apparatus, reduction of engine load, downsizing of an oil pump, etc. can be obtained.

18 Claims, 5 Drawing Sheets

(a)

(b)

VALVE TIMING CHANGER

TECHNICAL FIELD

The present invention relates to a valve timing change apparatus which changes the open-close timing of at least one of an intake valve and an exhaust valve of an internal combustion engine.

BACKGROUND ART

As a conventional valve timing change apparatus to change the open-close timing of an intake valve or an exhaust valve of an internal combustion engine, the structure which changes the rotational phases of a cam shaft to drive the intake valve or the exhaust valve and a crank shaft is known. For example, such a structure is disclosed in Japanese Patent No. 3033582, Japanese Patent laid-open 2000-274215, etc.

The apparatus disclosed in Japanese Patent No. 3033582 comprises an advancing oil-pressure chamber and a retarding oil-pressure chamber disposed at both sides of a vane which rotates within a specific angle range in a housing, and a lubricating oil passage communicating with both oil-pressure chambers. Then, by a switching valve (namely, an oil control valve) disposed at some midpoint of the lubricating oil passage, the lubricating oil introduced to both chambers is appropriately controlled, and pressure difference between both chambers is relatively generated. In this manner, the rotational phases of the cam shaft and the crank shaft are changed.

Further, with the apparatus disclosed in Japanese Patent Laid-open 2000-274215, relative rotation is generated between a specific rotating member and a cam shaft by electromagnetically generated braking torque, and the rotational phases of the cam shaft and the crank shaft are changed via a gear mechanism, such as a worm gear, a hypoid gear, etc.

However, with the apparatus disclosed in Japanese Patent No. 3033582, since the switching valve disposed at some midpoint of the lubricating oil passage switches the flow of the lubricating oil and directly controls the charge and discharge of the lubricating oil, the driving force of a pump for supplying the lubricating oil is directly added as a load to the engine. Further, oil pressure drop is caused while passing though the lubricating oil passage. The drop of the oil pressure becomes significant, especially when this apparatus is disposed at both the intake side and the exhaust side (namely, two-apparatuses mounted), or when two apparatuses are respectively disposed at each cylinder head of both sides of a V-shaped engine (namely, four-apparatuses mounted). When the oil pressure drops as mentioned above, the change to desirable open-close timing cannot be reliably performed.

On the other hand, to prevent the oil pressure drop, the capacity of the pump for supplying lubricating oil has to be enlarged, which causes upsizing of an engine, increase of an engine load, etc.

With the apparatus disclosed in Japanese Patent Laid-open 2000-274215, problems such as impact noise of the teeth caused by backlash etc. of the gears, phase fluctuation caused by thrust play at the hypoid gear, etc. arise. Further, because it is a gear mechanism, the apparatus becomes mechanically complicated and upsized, which causes upsizing of an engine.

The present invention was devised in view of the problems of the related art. The object of the present invention is to provide a valve timing change apparatus which can reliably change the open-close timing at all drive modes of an engine, without being affected by lubricating oil supply capacity, circumstance conditions, etc., while achieving load reduction to the engine, structural simplification, downsizing, and so on.

DISCLOSURE OF THE INVENTION

The valve timing change apparatus of the present invention is for changing open-close timing of an intake valve or an exhaust valve of an internal combustion engine, by changing the relative angular position in the rotating direction between a cam shaft which drives the valve and a rotational drive member which receives rotational drive force of a crank shaft to rotate the cam shaft, which comprises an angle change mechanism changing and holding the relative angle position between the cam shaft and the rotational drive member by oil pressure, an oil pressure generating mechanism generating oil pressure for driving the angle change mechanism by relative rotation, and a drive member generating relative rotation at the oil pressure generating mechanism.

With this structure, when the drive member operates, relative rotation is generated at the oil pressure generating mechanism, and oil pressure is generated. The angle change mechanism is driven by the oil pressure, and the angular position of the cam shaft in the rotating direction is changed against the rotational drive member (for example, a sprocket, a timing pulley or the like). In this manner, the open-close timing of the valve is changed in accordance with engine conditions. Particularly, by adopting the oil pressure generating mechanism and the drive member, simplification and downsizing of the structure is obtained, and engine load is reduced, and oil pressure drop is suppressed. Therefore, a plurality of the apparatuses can be mounted on an engine. Further, change operation of open-close timing of a valve can be reliably performed at all drive modes of an engine.

In the abovementioned structure, the angle change mechanism, the oil pressure generating mechanism, and the drive member can be arranged coaxially to the cam shaft.

With this structure, angle change operation of the angle change mechanism, oil pressure generating operation of the oil pressure generating mechanism, and drive operation of the drive means are performed in the vicinity including the axis of the cam shaft. Therefore, each operation is efficiently performed while eliminating waste. Further, since each structural part is aggregated towards the axis of the cam shaft, the apparatus becomes compact.

In the abovementioned structure, the angle change mechanism can be arranged so that the angular position of the cam shaft against the rotational drive member moves in one direction by oil pressure and in the other direction by spring force.

With this structure of the angle change mechanism, one of advancing operation and retarding operation is performed by oil pressure, and the other of advancing operation and retarding operation is performed by the urging force of the spring. Consequently, since oil pressure is utilized only for either operation, operating oil consumption is reduced. Further, since the energy for generating oil pressure at either operation becomes unnecessary, engine load is reduced.

In the abovementioned structure, it is possible that the angle change mechanism has a first rotary member rotating integrally with the rotational drive member and a second rotary member rotating integrally with the cam shaft, and the first rotary member and the second rotary member define an advancing oil chamber and a retarding oil chamber to and from which the operating oil is charged and discharged, to rotate the cam shaft to the advancing side or the retarding side against the rotational drive member, and the oil pressure generating mechanism has a rotor defining an expansion-compression room of the operating oil while rotating integrally with the first rotary member and a casing rotatably supported so that the rotor sucks and ejects the operating oil with relative rotation to the casing, and the drive member has an electromagnetic coil for generating electromagnetic force to exert braking torque to the casing for suppressing rotation.

With this structure, when the electromagnetic coil is powered and braking torque is generated by the electromagnetic suction force, the rotation of the casing is suppressed, and relative rotation between the rotor and the casing is generated. Thus, the rotor generates oil pressure by sucking and pressurizing operating oil, and the oil pressure is exerted to the advancing oil chamber or the retarding oil chamber. Then, the cam shaft is rotated to the advancing side or the retarding side against the operational drive member, and is held at a specific angular position. In this manner, by utilizing electromagnetic suction force, relative rotation can be easily generated at the oil pressure generating mechanism.

In the abovementioned structure, it is possible that the oil pressure generating mechanism has a connecting passage for sucking the operating oil charged into one of the advancing oil chamber and the retarding oil chamber, and ejecting the operating oil towards the other of the advancing oil chamber and the retarding oil chamber.

With this structure, the operating oil introduced to the angle change mechanism is effectively utilized via the connecting passage as the operating oil for the oil pressure generating mechanism. Therefore, wasteful consumption of the operating oil can be reduced. Then, compared with the case of supplying the operating oil separately, engine load reduces and the engine power improves.

In the abovementioned structure, it is possible that the oil pressure generating mechanism is disposed adjacent to the first rotary member, and the connecting passage is formed at the first rotary member.

With this structure, a dedicated member for defining the connecting passage is not needed and the structure is simplified. Further, since the oil pressure generating mechanism and the angle change mechanism are disposed adjacent to each other, the connecting passage can be set short to a minimum and oil pressure drop etc. can be suppressed.

In the abovementioned structure, it is possible that the connecting passage comprises a first annular passage and a second annular passage formed approximately coaxially to the cam shaft and respectively connected to a suction port and an exhaust port of the oil pressure generating mechanism, and a first piercing hole and a second piercing hole respectively connecting the first annular passage and the second annular passage respectively to the retarding oil chamber and the advancing oil chamber.

With this structure, when rotation of the casing is suppressed and relative rotation between the casing and the rotor is generated, the operating oil in the retarding oil chamber is sucked through the suction port of the oil pressure generating mechanism via the first piercing hole and the first annular passage. Then, the pressurized operating oil is ejected through the exhaust port of the oil pressure generating mechanism and supplied into the advancing oil chamber via the second annular passage and the second piercing hole. In this manner, advancing operation is performed. Since the connecting passage (namely, the first annular passage) to connect the suction port with the retarding oil chamber and the connecting passage (namely, the second annular passage) to connect the exhaust port with the advancing oil chamber are formed in an annular shape, the operating oil flow (namely, exchanging) between the angle change mechanism and the oil pressure generating mechanism can be performed without regard to the relative angular positions. Therefore, the change operation can be reliably performed.

In the abovementioned structure, it is possible that the rotor has an inner rotor directly connected to the first rotary member, and an outer rotor defining the expansion-compression room of the operating oil with the inner rotor.

With this structure, when the rotation of the casing is suppressed and relative rotation between the casing and the rotor is generated, the sucking operation and the ejecting operation of the operating oil is performed while the inner rotor and the outer rotor (for example, two rotors forming a trochoid pump, two rotors forming a gear pump, or the like) work together.

In the abovementioned structure, it is possible that the angle change mechanism has an oil passage to introduce lubricating oil of an internal combustion engine.

With this structure, engine lubricating oil is supplied to the angle change mechanism as the operating oil. Since the oil pressure generating mechanism generates oil pressure separately, the energy to supply the lubricating oil can be reduced relative to that of a conventional case, and engine load can be reduced.

BRIEF DISCRIPTION OF THE DRAWINGS

Figure 4:
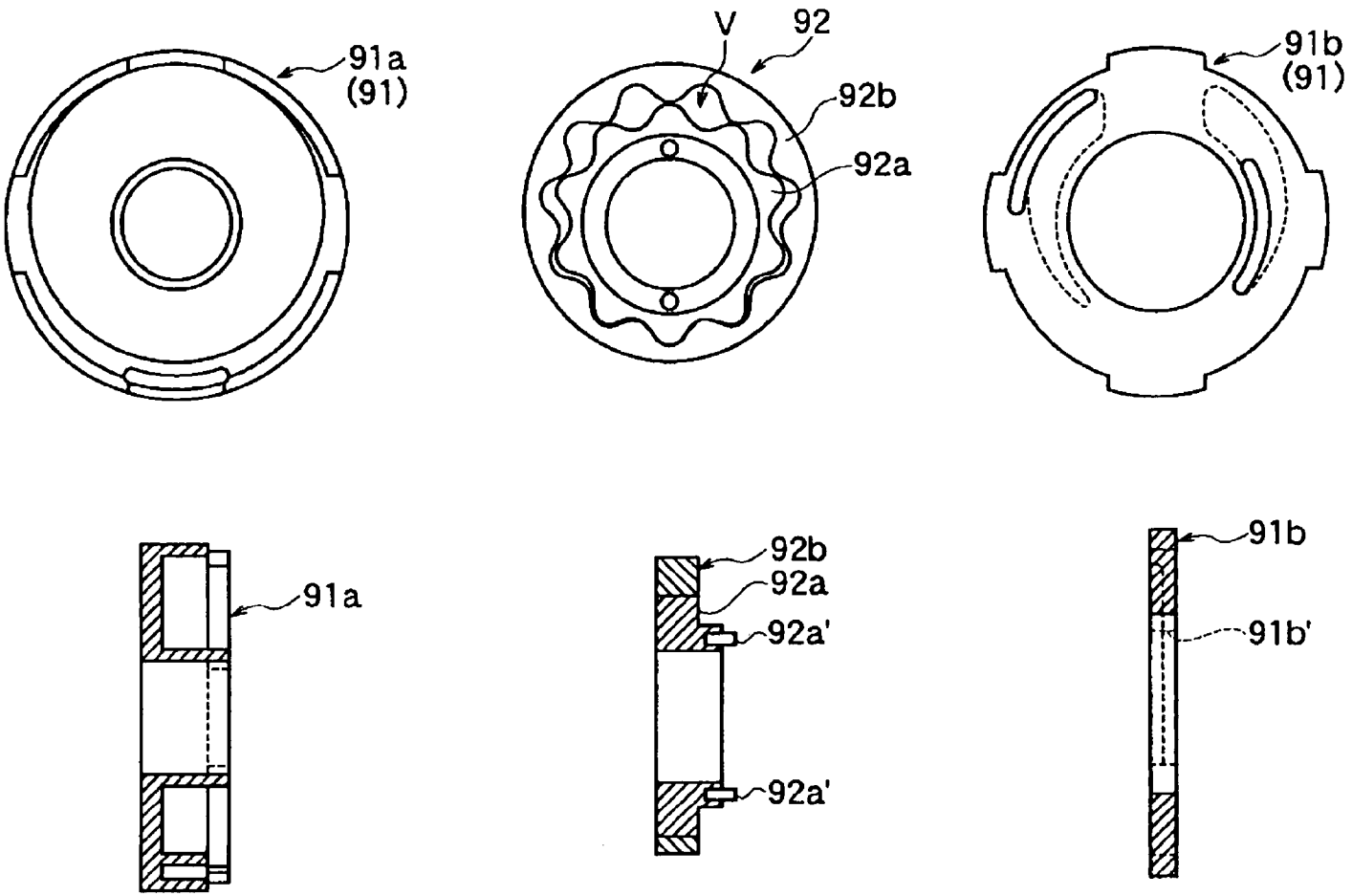

FIGS. 4(*a*)–(*f*) are rear views and sectional views of each disassembled part of the oil pressure generating mechanism.

Figure 5:
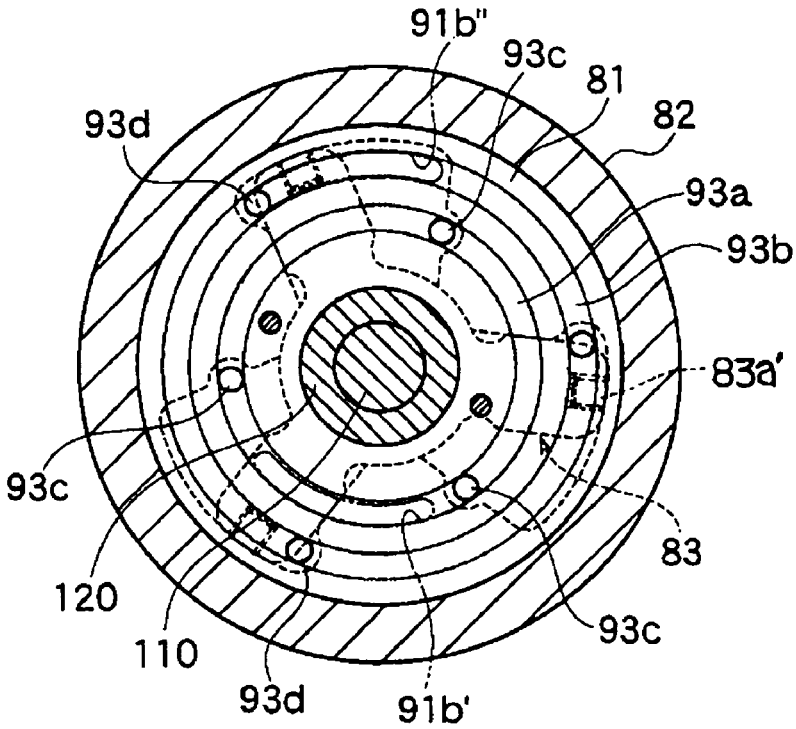
Figure 5:
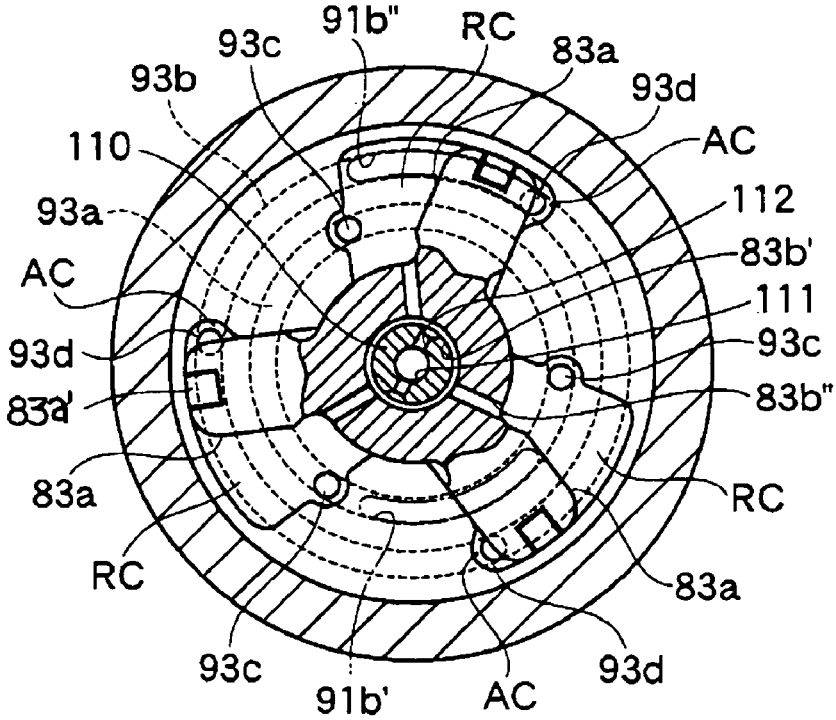

FIGS. 5(*a*) and 5(*b*) show a front view and a rear view of a connecting passage of the oil pressure generating mechanism and the inside of an angle change mechanism.

DETAILED DESCRIPTION OF THE INVENTION

The embodiments of the present invention are explained in the following with reference to the attached drawings.

Figure 1:
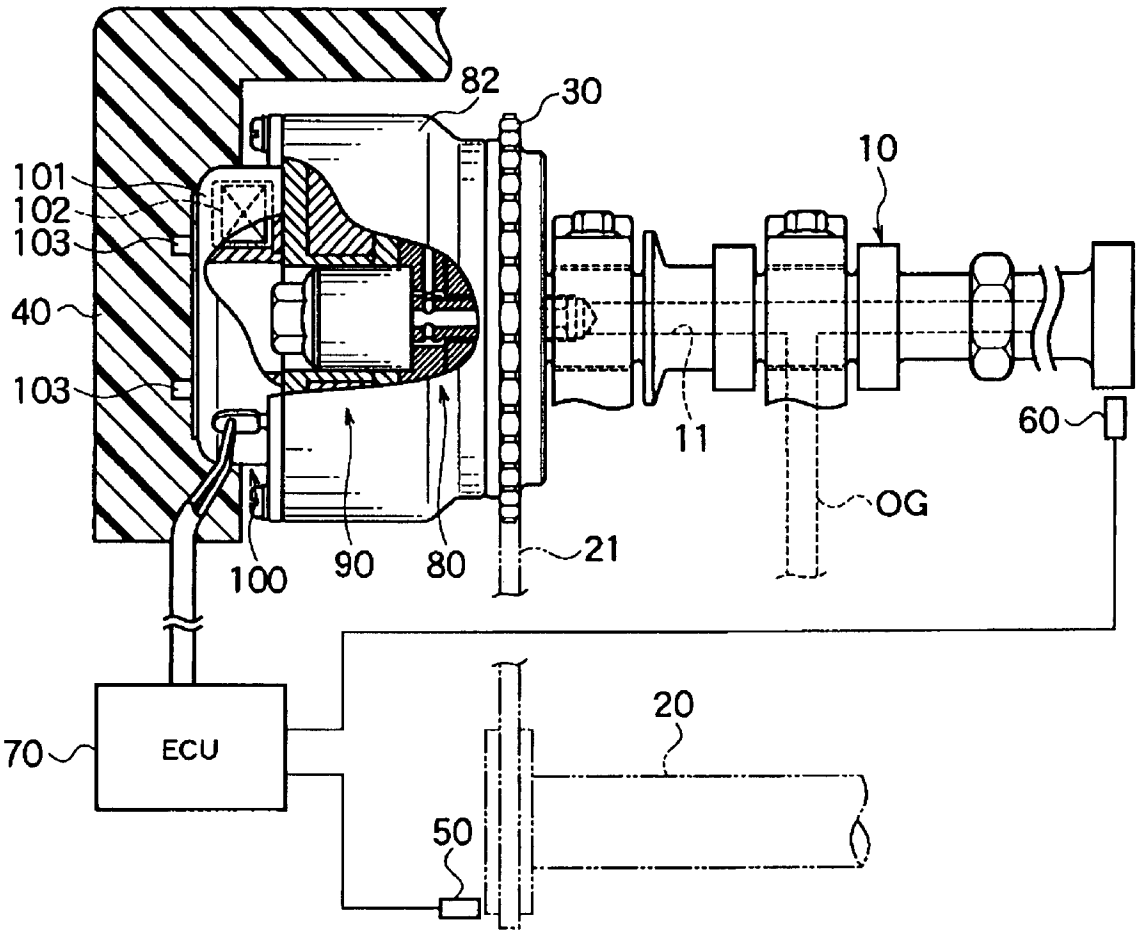
FIG. 1 is an abbreviated schematic drawing showing an embodiment of a valve timing change apparatus of the present invention.
Figure 2:
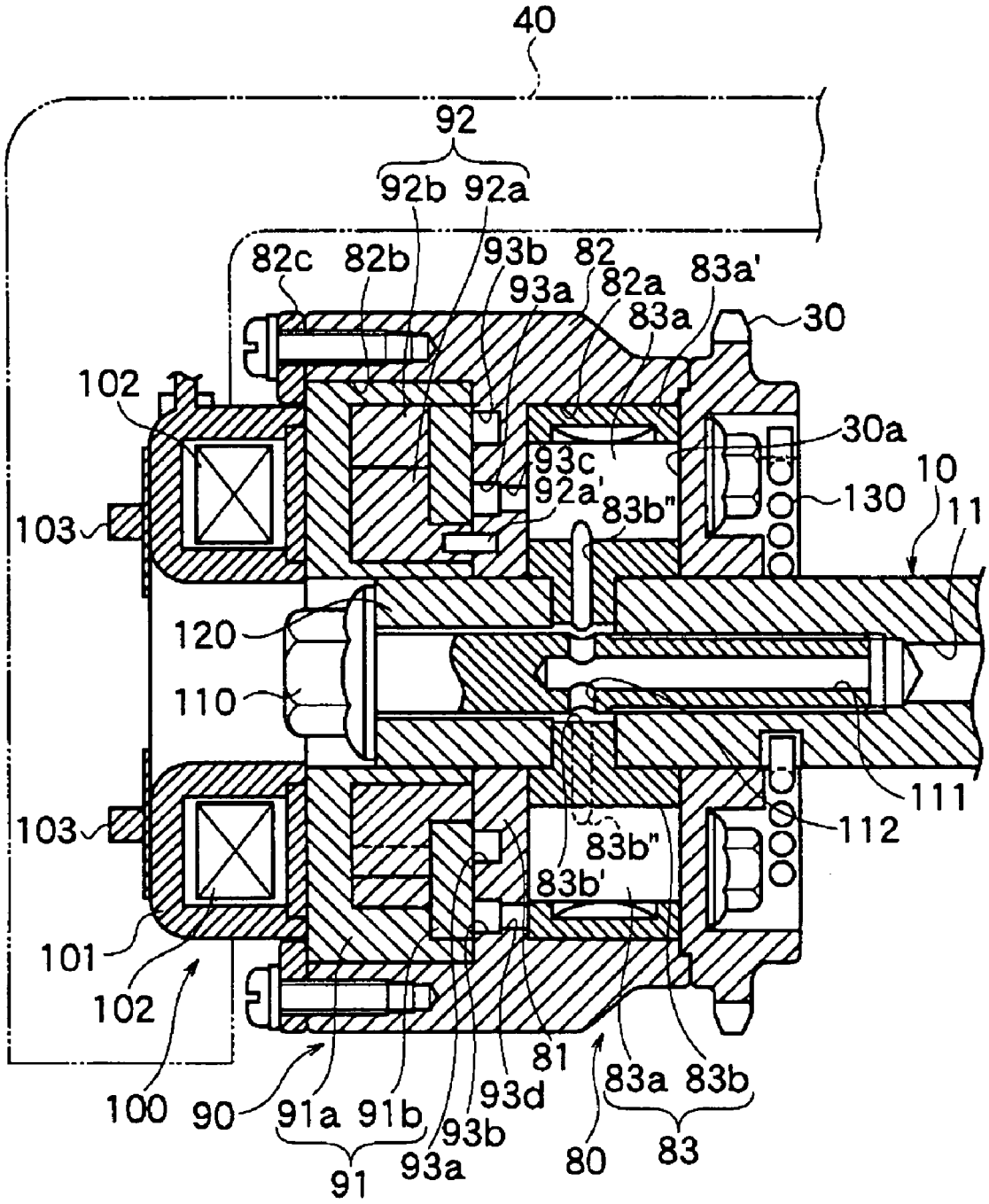
FIG. 2 is a sectional view of the valve timing change apparatus.
Figure 3:
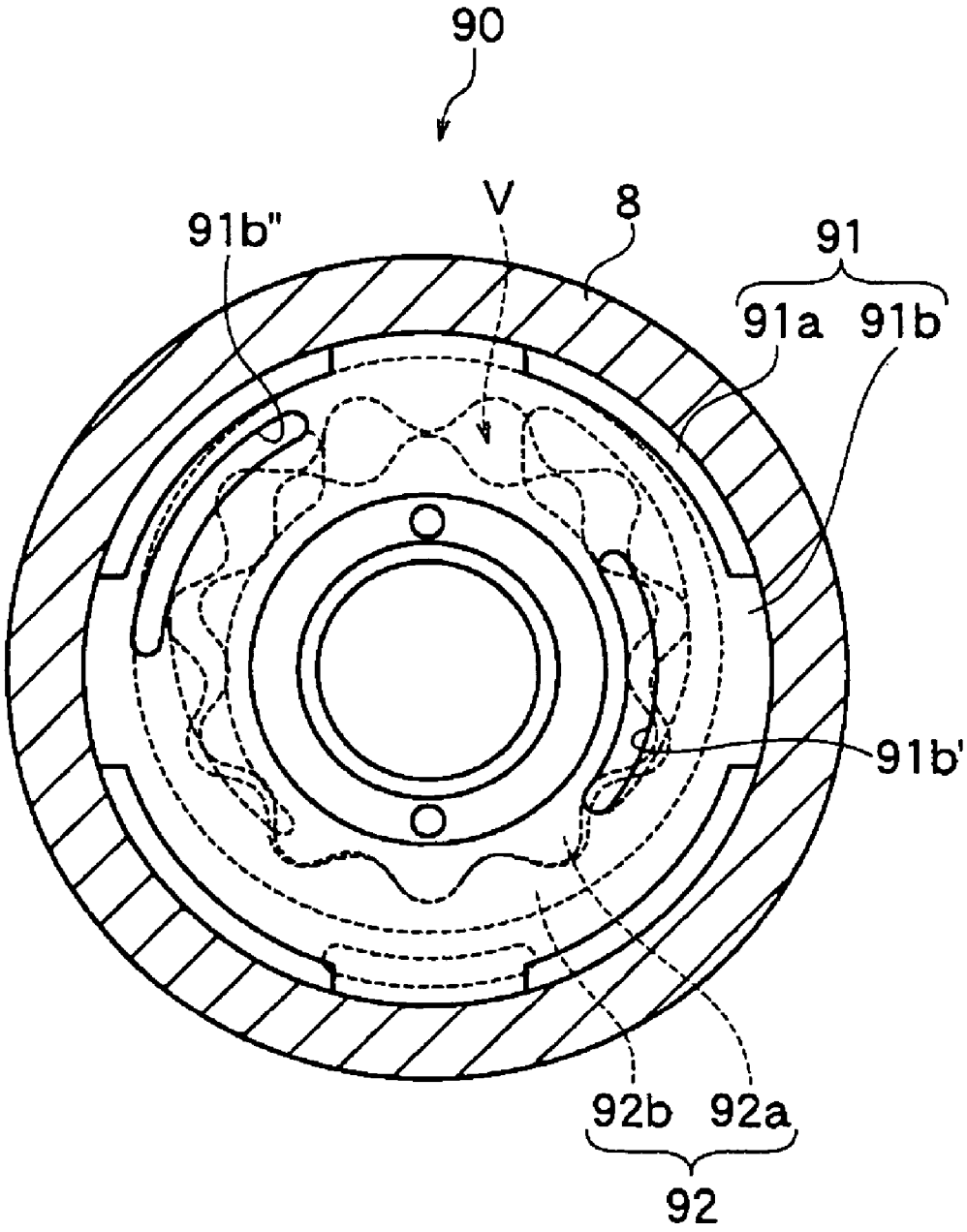
FIG. 3 is a rear view of an oil pressure generating mechanism which forms a part of the valve timing change apparatus.

FIGS. 1 through 5(*b*) show an embodiment of a valve timing change apparatus of the present invention. FIG. 1 is an abbreviated schematic drawing. FIG. 2 is a sectional view of a main part. FIG. 3 is a rear view of an oil pressure generating mechanism. FIGS. 4(*a*)–(*f*) are front and rear views of component parts of the oil pressure generating mechanism. FIGS. 5(*a*) and (*b*) are a front view and a rear view of an angle change mechanism.

As shown in FIG. 1, an internal combustion engine to which the apparatus is mounted comprises a cam shaft 10 driving an intake valve or an exhaust valve, a crank shaft 20 making a piston reciprocate, a chain 21 transmitting rotational drive force of the crank shaft 20 to the cam shaft 10, a sprocket 30 as a rotational drive member, a cylinder head cover 40, a crank angle sensor 50 detecting rotational angle of the crank shaft 20, a cam angle sensor 60 detecting rotational angle of the cam shaft 10, an engine control unit (ECU) 70 controlling engine operation, and so on.

Here, the apparatus is to set the open-close timing of the valve in accordance with engine drive modes by changing the relative angular position between the cam shaft 10 and the sprocket 30 in the rotating direction. As shown in FIG. 2, the apparatus comprises an angle change mechanism 80 for changing and holding the relative angular position between the cam shaft 10 and the sprocket 30 by oil pressure, an oil pressure generating mechanism 90 generating oil pressure by relative rotation for driving the angle change mechanism 80, an electromagnetic retarder 100 as a drive member for generating relative rotation at the oil pressure generating mechanism 90, and so on.

As shown in FIGS. 2 through 5(*b*), the angle change mechanism 80 comprises a housing rotor 82 as a cylindrical first rotary member in which a separating wall 81 is disposed, a vane rotor 83 as a second rotary member disposed to be reciprocatable within a specific angular range in the space (of one side of the separating wall 81) inside the housing rotor 82, and so on.

The housing rotor 82 is rotatably supported coaxially to the cam shaft 10 by a cylindrical spacer 120 fitted to the outside of a bolt 110 which is fastened to the cam shaft 10. The sprocket 30 which is rotatably supported by the cam shaft 10 is fixed to the end surface of the housing rotor 82 to rotate integrally.

As shown in FIG. 2 though 5, the vane rotor 83 has three vane portions 83*a* and a hub portion 83*b*. A seal 83*a*' intimately contacting an inner circumference 82*a* of the housing rotor 82 is disposed at the top end of the vane portion 83*a*. A piercing hole 83*b*' as a lubricating oil passage, and three passages 83*b*" as lubricating oil passages connecting to the piercing hole 83*b*' and extending to open in the diameter direction are formed at the hub portion 83*b*. Then, the hub portion 83*b* is fastened by the bolt 110 being sandwiched with the end surfaces of the cylindrical spacer 120 and the cam shaft 10.

A passage 111 connecting to the lubricating oil passage 11 formed in the cam shaft 10, and a passage 112 connecting to the piercing hole 83*b*' and the passages 83*b*" are formed in the bolt 110. Engine lubricating oil as the operating oil introduced through the lubricating oil passage 11 is led into a retarding oil chamber RC, which is explained later, via the passages 111, 112, the piercing hole 83*b*', and the passages 83*b*". Here, the lubricating oil passage 11 introduces the engine lubricating oil supplied by an oil pump via a lubricating oil passage OG formed in a cylinder block.

With this structure, the vane rotor 83 integrally rotates with the cam shaft 10. Further, the vane rotor 83 can rotate relative to the housing rotor 82 within a specific angular range in the space defined by the separating wall 81 and the inner circumference 82*a* of the housing rotor 82, and the front surface 30*a* of the sprocket 30.

Consequently, as shown in FIG. 5(*b*), the housing rotor 82 and the vane rotor 83 form the advancing oil chamber AC and the retarding oil chamber RC to and from which the lubricating oil is charged and discharged, to rotate the cam shaft 10 to the advancing side or the retarding side with the operation of the oil pressure generating mechanism 90.

As shown in FIG. 2, a torsion spring 130 is disposed between the sprocket 30 and the cam shaft 10. The torsion spring 130 exerts the spring force in the direction to rotate the cam shaft 10 counterclockwise in FIG. 5(*a*) against the sprocket 30 (and the housing rotor 82).

Therefore, in the state that the advancing oil chamber AC is not filled with the lubricating oil, the cam shaft 10 (the vane rotor 83) is rotated to and held at the most retarded angular position by the spring force of the torsion spring 130.

In this manner, since the retarding operation of the angle change mechanism 80 is performed by the spring force of the torsion spring 130, the corresponding energy to generate the oil pressure for retarding becomes unnecessary. Consequently, engine load etc. is reduced and oil consumption is also reduced.

As shown in FIGS. 2 through 4, the oil pressure generating mechanism 90 comprises a casing 91, a rotor 92 rotatably accommodated in the casing 91, a connecting passage 93 formed at the separating passage 81, and so on.

The casing 91 has a brake drum 91*a* which is rotatably supported coaxially to the cam shaft 10 between the outer circumference of the cylindrical spacer 120 and the inner circumference 82*b* of the housing rotor 82 and which movement in the thrust direction is restricted by the separating wall 81 and a stopper ring 82*c*, and a plate 91*b* connected to the brake drum 91*a*. A suction port 91*b*' for sucking the lubricating oil inside, and an exhaust port 91*b*" for ejecting the lubricating oil outside are formed at the plate 91*b*.

The rotor 92 has an inner rotor 92*a* rotating coaxially to the rotation center of the casing 91 (namely, the cam shaft 10), and an outer rotor 92*b* which rotation center is deviated by a specific amount and which is rotated while being engaged with the inner rotor 92*a*. Further, the inner rotor 92*a* is connected to the separating wall 81 by a pin 92*a*', and rotates integrally with the housing rotor 82.

A connecting passage 93 for flow of the lubricating oil is formed at the separating wall 81. As shown in FIGS. 2 through 5(*b*), the connecting passage 93 has a first annular passage 93*a* connected to the suction port 91*b*' and a second annular passage 93*b* connected to the exhaust port 91*b*" being approximately coaxial to the cam shaft 10, a first piercing hole 93*c* connecting the first annular passage 93*a* to the retarding oil chamber RC, and a second piercing hole 93*d* connecting the second annular passage 93*b* to the advancing oil chamber AC.

Consequently, in the oil pressure generating mechanism 90, the rotor 92 rotatably accommodated in the casing 91 defines an expansion-compression room V which expands to suck the lubricating oil from the suction port 91*b*' and compresses to eject the sucked lubricating oil through the exhaust port 91*b*", (while the inner rotor 92*a* and the outer rotor 92*b* work together), as shown in FIG. 3 and FIG. 4(*b*).

Then, when the casing 91 rotates slower than the rotor 92, (namely, when relative rotation is generated), the oil pressure generating mechanism 90 works as a trochoid pump. That is, the pump effect, to suck the lubricating oil into the suction port 91*b*' from the retarding oil chamber RC via the first piercing hole 93*c* and the first annular passage 93*a*, and to eject the lubricating oil to the advancing oil chamber AC from the exhaust port 91*b*" via the second annular passage 93*b* and the second piercing hole 93*d*, is obtained. In this manner, the oil pressure to drive the angle change mechanism 80 is generated. On the contrary, when the casing 91 rotates integrally with the rotor 92, the abovementioned pump effect cannot be obtained and the oil pressure to drive the angle change mechanism 80 cannot be generated.

As mentioned above, with the oil pressure generating mechanism 90, since the lubricating oil introduced to the angle change mechanism 80 via the connecting passage 93 is utilized as the operating oil, wasteful consumption of the lubricating oil can be reduced. Compared with the case of supplying the operating oil separately, engine load is reduced and the engine power is improved.

Further, since the connecting passage 93 is formed at the separating wall 81 of the housing rotor 82 as the first rotate member, a dedicated member for defining the connecting passage is not needed and the structure can be simplified. Furthermore, since the oil pressure generating mechanism 90 and the angle change mechanism 80 are disposed adjacent to each other sandwiching the separating wall 81, the connecting passage 93 can be set short to a minimum and oil pressure drop by flow resistance etc. can be suppressed.

Furthermore, since the first annular passage 93*a* and the second annular passage 93*b* are adopted, the lubricating oil flow (namely, exchanging) between the angle change mechanism 80 and the oil pressure generating mechanism 90 can be reliably performed without regard to the relative angular positions. Therefore, the change operation of the open-close timing of the valve can be reliably performed.

As shown in FIG. 1 and FIG. 2, the electromagnetic retarder 100 has an approximately annular case 101 disposed adjacent to the brake drum 91*a* and coaxial to the cam shaft 10, an electromagnetic coil 102 accommodated in the case 101, and so on. Then, the electromagnetic retarder 100 is fixed to the cylinder head cover 40 by fitting with a pin 103 projecting from the end surface of the case 101.

With the electromagnetic retarder 100, when the electromagnetic coil 102 is powered, electromagnetic suction force is generated and the casing 91 (the brake drum 91*a*) is attracted. In this manner, braking torque to suppress the rotation of the casing 91 is generated.

Thus, by utilizing electromagnetic suction force as braking torque, relative rotation between the casing 91 of the oil pressure generating mechanism 90 and the rotor 92 can be generated with a simple structure.

As mentioned above, since the angle change mechanism 80, the oil pressure generating mechanism 90, and the electromagnetic retarder 100 are arranged coaxially to the cam shaft 10, angle change operation by oil pressure, oil pressure generating operation (pump effect), and activating operation of oil pressure generating are performed in the vicinity including the axis of the cam shaft 10. Therefore, each operation is efficiently performed while eliminating waste. Further, since each structural part is aggregated towards the axis of the cam shaft 10, the apparatus becomes compact.

Next, the operation of the apparatus is explained. Here, a drive mode of an engine is determined by the ECU 70 being based on detection signals of the crank angle sensor 50 and the cam angle sensor 60 etc. In accordance with the determined drive mode, the operation of the electromagnetic retarder 100, namely ON/OFF of powering to the electromagnetic coil 102 and magnitude of current etc., is controlled.

Firstly, when the electromagnetic coil 102 is not powered, braking torque is not generated. Since the casing 91 and the rotor 92 integrally rotate, the oil pressure generating mechanism 90 does not generate oil pressure. Therefore, in the angle change mechanism 80, the housing rotor 82 (the sprocket 30) and the cam shaft 10 are returned to a specific relative angular position by the spring force of the torsion spring 130. The cam shaft 10 is held at the most retarded angular position against the sprocket 30.

Next, when the electromagnetic coil 102 is powered based on the control signal of the ECU 70, braking torque is generated and the rotation of the casing 91 (brake drum 91*a*) is suppressed. In this way, relative rotation between the rotor 92 and the casing 91 is generated. Then, the oil pressure generating mechanism 90 is activated and pumping operation starts for sucking and ejecting the lubricating oil.

Consequently, the lubricating oil charged into the retarding oil chamber RC is sucked into the rotor 92 from the suction port 91*b*' via the first piercing hole 93*c* and the first annular passage 93*a*. Then, the lubricating oil compressed by the rotor 92 is ejected from the exhaust port 91*b*", and introduced into the advancing oil chamber AC via the second annular passage 93*b* and the second piercing hole 93*d*.

Here, the pumping operation is controlled to have the adequate discharge characteristic, by adequately controlling the powering to the electromagnetic coil 102 so as to change the magnitude of braking torque and adequately control the rotation speed of the casing 91.

With this operation, the oil pressure in the advancing oil chamber AC overcomes the spring force of the torsion spring 130, and the vane rotor 83, namely the cam shaft 10, is rotated to a desired angular position at the advancing side against the sprocket 30. Then, the vane rotor 83 is held at the angular position where the spring force of the torsion spring 130 and the oil pressure of the lubricating oil discharged by the oil pressure generating mechanism 90 are in balance (namely, close to each other).

On the contrary, when the powering to the electromagnetic coil 102 is discontinued based on the control signal of the ECU 70, braking torque disappears, and the casing 91 (the brake drum 91*a*) and the rotor 92 rotate integrally. In this way, the pump operation of the oil pressure generating mechanism 90 is discontinued, and the oil pressure in the advancing oil chamber AC decreases. Then, the cam shaft 10 is rotated to and held at the most retarded angular position by the spring force of the torsion spring 130.

In this manner, the oil pressure generating mechanism 90 utilizes the lubricating oil which is previously introduced to the angle change mechanism 80 to generate oil pressure (namely, to supply the lubricating oil) for driving the angle change mechanism 80. Thus, compared with the conventional case of pressurizing and supplying the lubricating oil of the cylinder block side by an oil pump, engine load is reduced and wasteful consumption of the oil is reduced.

In the abovementioned embodiment, as the angle change mechanism, the structure having the housing rotor 82, the vane rotor 83, the advancing oil chamber AC, the retarding oil chamber RC, etc. is adopted. However, another structure can be adapted as long as the relative angular position between the cam shaft 10 and the sprocket 30 can be changed.

Further, in the abovementioned embodiment, as the operating oil for the angle change mechanism 80 and the oil pressure generating mechanism 90, engine lubricating oil is adopted. However, since the influence of the heat in this region is smaller than the lubricating oil, a structure for storing and circulating dedicated operating oil which is separate from engine lubricating oil can be adopted.

Furthermore, in the abovementioned embodiment, a structure in which the angle change mechanism 80, the oil pressure generating mechanism 90, and the electromagnetic retarder 100 are coaxially arranged is shown. However, the invention is not limited to this structure, and a structure disposing the oil pressure generating mechanism and the electromagnetic retarder at another position, connecting the oil pressure generating mechanism and the angle change mechanism with an operating oil passage etc., and driving the oil pressure generating mechanism separately can be adopted.

Furthermore, in the abovementioned embodiment, the sprocket 30 is shown as a rotational drive member to transmit rotational drive force of the crank shaft to the cam shaft 10. However, the invention is not limited to this structure, and it is also possible to adopt a timing pulley or the like which transmits rotational drive force of the crank shaft by a belt. Further, as the rotor 92 of the oil pressure generating mechanism 90, the inner rotor 92*a* and the outer rotor 92*b* which form a trochoid pump are shown. However, the invention is not limited to this structure, and it is also possible to adopt two rotors which form a gear pump.

INDUSTRIAL APPLICABILITY

As mentioned above, the valve timing change apparatus of the present invention comprises an angle change mechanism for changing and holding the relative angular position between a cam shaft and a rotational drive member (namely, a sprocket etc.) by oil pressure, an oil pressure generating mechanism for driving the angle change mechanism, a drive member for driving the oil pressure generating mechanism, and so on. Thus, simplification and downsizing of the apparatus, reduction of engine load, suppression of oil pressure drop, etc. can be obtained. Then, a plurality of the apparatus can be mounted on an engine. Further, change operation of open-close timing of a valve can be reliably performed in all drive modes of an engine.

The invention claimed is:

1. A valve timing change apparatus for changing open-close timing of an intake valve or an exhaust valve of an internal combustion engine, by changing the relative angular position in the rotating direction between a cam shaft which drives said valve and a rotational drive member which receives rotational drive force of a crank shaft to rotate said cam shaft, comprising:

an angle change mechanism configured to change and hold the relative angular position between said cam shaft and said rotational drive member by oil pressure;

an oil pressure generating mechanism configured to generate oil pressure for driving said angle change mechanism by relative rotation; and a drive member configured to generate relative rotation at said oil pressure generating mechanism;

wherein said angle change mechanism has a first rotary member integrally rotatable with said rotational drive member and a second rotary member integrally rotatable with said cam shaft;

wherein said first rotary member and said second rotary member define an advancing oil chamber and a retarding oil chamber to and from which the operating oil is charged and discharged, to rotate said cam shaft to the advancing side or the retarding side against said rotational drive member;

wherein said oil pressure generating mechanism has a rotor configured to define an expansion-compression room of the operating oil and to rotate integrally with said first rotary member, and a casing rotatably supported so that said rotor sucks and ejects the operating oil with relative rotation to said casing; and wherein said drive member has an electromagnetic coil for generating electromagnetic force to exert braking torque to said casing for suppressing rotation.

2. The valve timing change apparatus according to claim 1, wherein said oil pressure generating mechanism has a connecting passage for sucking the operating oil charged into one of said advancing oil chamber and said retarding oil chamber, and ejecting the operating oil towards the other of said advancing oil chamber and said retarding oil chamber.

3. The valve timing change apparatus according to claim 2, wherein said oil pressure generating mechanism is disposed adjacent to said first rotary member, and said connecting passage is formed at said first rotary member.

4. The valve timing change apparatus according to claim 3, wherein said connecting passage comprises a first annular passage and a second annular passage formed approximately coaxially to said cam shaft and respectively connected to a suction port and an exhaust port of said oil pressure generating mechanism, and a first piercing hole and a second piercing hole respectively connecting said first annular passage and said second annular passage respectively to said retarding oil chamber and said advancing oil chamber.

5. The valve timing change apparatus according to claim 1, wherein said rotor has an inner rotor directly connected to said first rotary member, and an outer rotor defining the expansion-compression room of the operating oil with said inner rotor.

6. The valve timing change apparatus according to claim 2, wherein said rotor has an inner rotor directly connected to said first rotary member, and an outer rotor defining the expansion-compression room of the operating oil with said inner rotor.

7. The valve timing change apparatus according to claim 3, wherein said rotor has an inner rotor directly connected to said first rotary member, and an outer rotor defining the expansion-compression room of the operating oil with said inner rotor.

8. The valve timing change apparatus according to claim 4, wherein said rotor has an inner rotor directly connected to said first rotary member, and an outer rotor defining the expansion-compression room of the operating oil with said inner rotor.

9. The valve timing change apparatus according to claim 1, wherein said angle change mechanism has an oil passage to introduce lubricating oil of an internal combustion engine.

10. The valve timing change apparatus according to claim 2, wherein said angle change mechanism has an oil passage to introduce lubricating oil of an internal combustion engine.

11. The valve timing change apparatus according to claim 3, wherein said angle change mechanism has an oil passage to introduce lubricating oil of an internal combustion engine.

12. The valve timing change apparatus according to claim 4, wherein said angle change mechanism has an oil passage to introduce lubricating oil of an internal combustion engine.

13. The valve timing change apparatus according to claim 5, wherein said angle change mechanism has an oil passage to introduce lubricating oil of an internal combustion engine.

14. A valve timing change apparatus for changing open-close timing of an intake valve or an exhaust valve of an internal combustion engine, by changing the relative angular position in the rotating direction between a cam shaft which drives said valve and a rotational drive member which receives rotational drive force of a crank shaft to rotate said cam shaft, comprising:

an angle change mechanism configured to change and hold the relative angular position between said cam shaft and said rotational drive member by oil pressure;

an oil pressure generating mechanism configured to generate oil pressure for driving said angle change mechanism by relative rotation; and a drive member configured to generate relative rotation at said oil pressure generating mechanism;

wherein said angle change mechanism, said oil pressure generating mechanism, and said drive member are arranged coaxially to said cam shaft;

wherein said angle change mechanism has a first rotary member integrally rotatable with said rotational drive member and a second rotary member integrally rotatable with said cam shaft;

wherein said first rotary member and said second rotary member define an advancing oil chamber and a retarding oil chamber to and from which the operating oil is charged and discharged, to rotate said cam shaft to the advancing side or the retarding side against said rotational drive member;

wherein said oil pressure generating mechanism has a rotor defining an expansion-compression room of the operating oil while rotating integrally with said first rotary member, and a casing rotatably supported so that said rotor sucks and ejects the operating oil with relative rotation to said casing; and wherein said drive member has an electromagnetic coil for generating electromagnetic force to exert braking torque to said casing for suppressing rotation.

15. The valve timing change apparatus according to claim 14, wherein the angular position of said cam shaft against said rotational drive member moves in one direction by oil pressure and in the other direction by spring force.

16. The valve timing change apparatus according to claim 14, wherein said angle change mechanism has an oil passage to introduce lubricating oil of an internal combustion engine.

17. A valve timing change apparatus for changing open-close timing of an intake valve or an exhaust valve of an internal combustion engine, by changing the relative angular position in the rotating direction between a cam shaft which drives said valve and a rotational drive member which receives rotational drive force of a crank shaft to rotate said cam shaft, comprising:

an angle change mechanism configured to change and hold the relative angular position between said cam shaft and said rotational drive member by oil pressure;

an oil pressure generating mechanism configured to generate oil pressure for driving said angle change mechanism by relative rotation; and a drive member configured to generate relative rotation at said oil pressure generating mechanism;

wherein the angular position of said cam shaft against said rotational drive member moves in one direction by oil pressure and in the other direction by spring force;

wherein said angle change mechanism has a first rotary member integrally rotatable with said rotational drive member and a second rotary member integrally rotatable with said cam shaft;

wherein said first rotary member and said second rotary member define an advancing oil chamber and a retarding oil chamber to and from which the operating oil is charged and discharged, to rotate said cam shaft to the advancing side or the retarding side against said rotational drive member;

wherein said oil pressure generating mechanism has a rotor configured to define an expansion-compression room of the operating oil and rotate integrally with said first rotary member, and a casing rotatably supported so that said rotor sucks and ejects the operating oil with relative rotation to said casing; and wherein said drive member has an electromagnetic coil for generating electromagnetic force to exert braking torque to said casing for suppressing rotation.

18. The valve timing change apparatus according to claim 17, wherein said angle change mechanism has an oil passage to introduce lubricating oil of an internal combustion engine.

* * * * *